US007434284B2

(12) United States Patent
Blanc

(10) Patent No.: US 7,434,284 B2
(45) Date of Patent: Oct. 14, 2008

(54) MULTI-PART LAST FOR MANUFACTURING SHOES

(75) Inventor: Roger Blanc, deceased, late of Le Pin (FR); by Viviane Blanc, legal representative, Le Pin (FR)

(73) Assignee: Etablissements Actis, Le Pin (FR)

( * ) Notice: Subject to any disclaimer, the term of this patent is extended or adjusted under 35 U.S.C. 154(b) by 448 days.

(21) Appl. No.: 10/553,806

(22) PCT Filed: Apr. 23, 2004

(86) PCT No.: PCT/FR2004/001001

§ 371 (c)(1),
(2), (4) Date: Nov. 18, 2005

(87) PCT Pub. No.: WO2004/095964

PCT Pub. Date: Nov. 11, 2004

(65) Prior Publication Data

US 2006/0162101 A1 Jul. 27, 2006

(30) Foreign Application Priority Data

Apr. 25, 2003 (FR) ..... 03 05123

(51) Int. Cl.
*A43D 23/00* (2006.01)

(52) U.S. Cl. ..... 12/133 R; 12/135 A; 12/135 R

(58) Field of Classification Search ..... 12/133 R, 12/128 R, 125 R, 135 A
See application file for complete search history.

(56) References Cited

U.S. PATENT DOCUMENTS

| | | | | | |
|---|---|---|---|---|---|
| 3,705,433 | A | * | 12/1972 | Stoddard et al. | 2/133 |
| 3,863,284 | A | * | 2/1975 | Liebscher | 12/135 A |
| 4,073,022 | A | * | 2/1978 | Bailey et al. | 12/135 A |
| 4,575,889 | A | | 3/1986 | Roseland et al. | |
| 5,054,147 | A | * | 10/1991 | Motsch | 12/133 R |

FOREIGN PATENT DOCUMENTS

| | | | |
|---|---|---|---|
| DE | 89 14 796 | U | 2/1990 |
| DE | 90 03 098 | U | 5/1990 |
| DE | 103 19 593 | A1 | 11/2003 |

* cited by examiner

*Primary Examiner*—Marie Patterson
(74) *Attorney, Agent, or Firm*—Oliff & Berridge, PLC

(57) ABSTRACT

The last is characterized in that the rear part and the main part are joined along a circular surface having a horizontal axis located above and at the front of the last. The rear part is provided with a generally U-shaped elastically deformable stirrup, whereby the branches thereof are designed in such a way that they are locked on the support of the last, whereby means are provided to ensure that the stirrup can be moved away from the support and that the rear part can be displaced, in relation to the main part, into a retracted position and vice-versa.

11 Claims, 5 Drawing Sheets

MULTI-PART LAST FOR MANUFACTURING SHOES

The subject of the present invention is a multi-part last for manufacturing shoes.

In order to make it easier to fit onto or remove from the lasts the uppers that make up shoes, it is known practice to produce lasts in which the rear part or heel seat is separate from the main part. In general, the rear part is mounted on the main part by means of link rods that allow the rear part to be brought above the main part in order to reduce the passage cross section of the whole, making it easier to fit and remove tall uppers, particularly those intended for boot making, which have a narrow passage.

While such a last has the advantage of reducing its cross section so that uppers can be fitted and removed, it has the disadvantage that actuation has to be performed manually, this operation being lengthy and painstaking.

The technical problem underlying the invention is that of producing a multi-part last that can change from a normal position of use into a retracted position simply and quickly, with the possibility of automating this switch from one position to the other.

To this end, the last to which the invention relates is of the type comprising a main part mounted on a support equipped with holding means and a rear part mounted so that it can move with respect to the main part between a position in which it forms the last with the main part for operations of producing the shoe and a position in which the rear part is displaced relative to the main part in a direction of retraction under the latter.

According to the invention, this last is characterized in that:

- the rear part and the main part meet along a circular surface of horizontal axis situated above and on the front side of the last,
- the rear part is equipped with a clip in the overall shape of a U that is elastically deformable and the branches of which are intended to lock onto the last support,
- means being provided for disengaging the clip from the support and displacing the rear part with respect to the main part into a retracted position, and vice versa.

The clip secures the rear part of the last to the support, in the work position. In order to switch from the work position to the retracted position, the rear part is grasped by the manipulator, detached from the support of the main part, and brought into the retracted position, more or less in the continuation of the main part.

According to one feature of the invention, the clip is made of metal.

Advantageously, the branches of the clip each comprise at least one hole for the engagement of at least one finger belonging to the support when the clip is in the position in which it is locked onto the support, whereas the clip comprises a centering finger intended to engage in a hole belonging to the support, when the rear part of the last is in the position in which it is locked onto the support.

This arrangement provides excellent attachment between the clip and, as a result, the rear part of the last, and the support. The elasticity of the branches of the clip ensures that the clip holds fast on the support when the rear part is in the position in which it is mounted on the support, while the parting of its branches allows these to be disengaged from the retaining fingers holding it on the support before the rear part is displaced with respect to the main part of the last.

According to another feature of the invention, the clip is mounted removably on the rear part of the last by engaging in a slit formed in this rear part or in a component secured thereto.

This interchangeability of the clip is advantageous because it allows it to be replaced should it become worn.

According to another feature of the invention, the curved contact surfaces of the main part and of the rear part of the last are fitted with a guide rib and with a guide groove respectively, providing guidance in the plane of displacement of these two parts one with respect to the other.

Advantageously, the end regions of the two branches of the clip are offset outwards, parallel to the respective planes of the two branches. These end regions make it easier for a manipulator to grasp hold of the branches, in as much as these end regions are separated from the support of the main part of the last.

According to another aspect of the invention, the means provided for disengaging the clip from the support and displacing the rear part with respect to the main part consist of an external manipulator, that is to say one independent of the main part of the last, grasping the ends of the branches of the clip, detaching them from the support, and then displacing the rear part of the last relative to the main part in a pivoting movement.

Advantageously in this case, the manipulator comprises two forks which, intended to grasp the end regions of the two branches of the clip, are associated with actuators that enable the branches to be parted and grasped in order to disengage them from the last support, the forks themselves being mounted on a support fixed on at least one arm mounted to pivot about the pivot pin on which the curved surface where the main and rear parts of the last meet is centered.

At the end of the pivoting travel of the rear part of the last with respect to the main part, the rear part is a relatively long distance away from the main part because of the fact that the rear part moves along a curved surface whereas the underside of the last makes an angle with the curved meeting surface.

In order to make the assembly more compact, at the end of the pivoting travel, the manipulator displaces the rear part of the last in a translational movement in order to press it firmly against the underside of the main part.

According to one possibility, the pivot pin about which the arm bearing the forks of the manipulator pivots is mounted in an elongate slot which, with the aid of an actuator, allows this pivot pin, the forks and the rear part of the last to be displaced toward the underside of the main part of this last at the end of the pivoting movement of the rear part.

In any event, the invention will be clearly understood with the aid of the description which follows, with reference to the attached diagrammatic drawing which, by way of nonlimiting examples, depicts one embodiment of this last and one embodiment of a manipulator associated with it.

Figure 2:
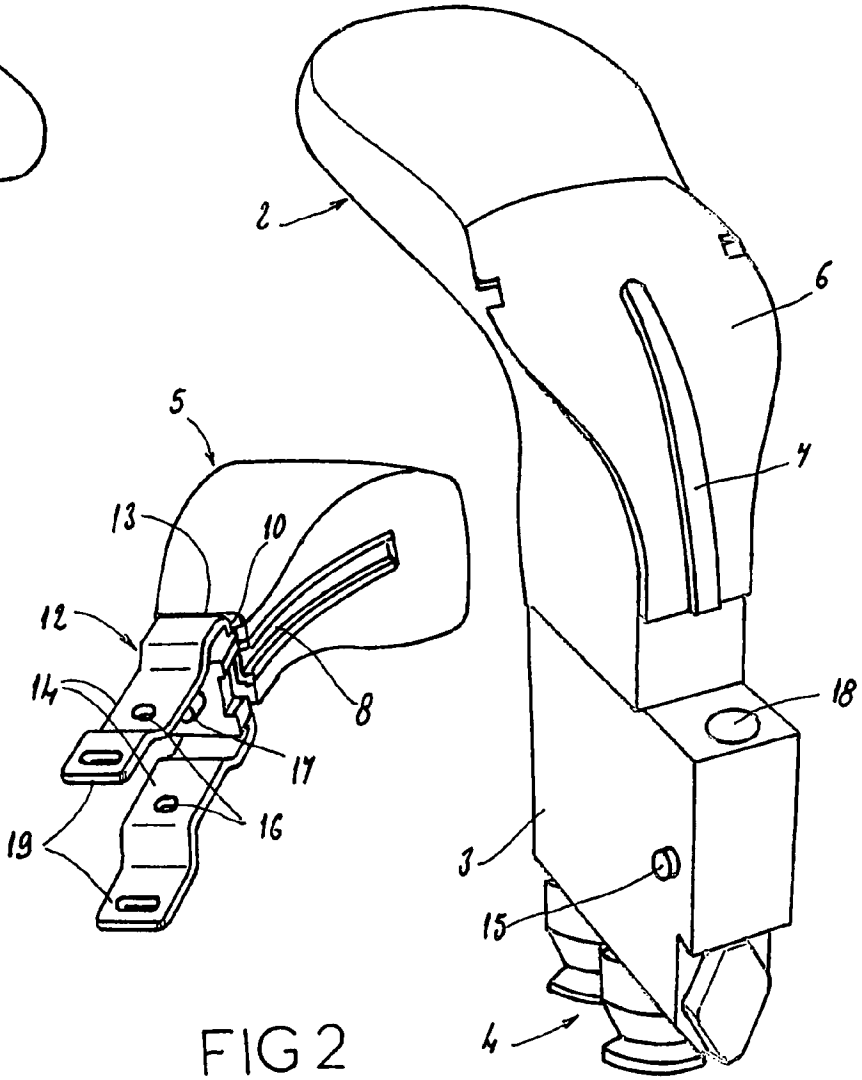
FIG. 2 is a perspective view of the two, main and rear, parts of this last in the disassembled position.
Figure 1:
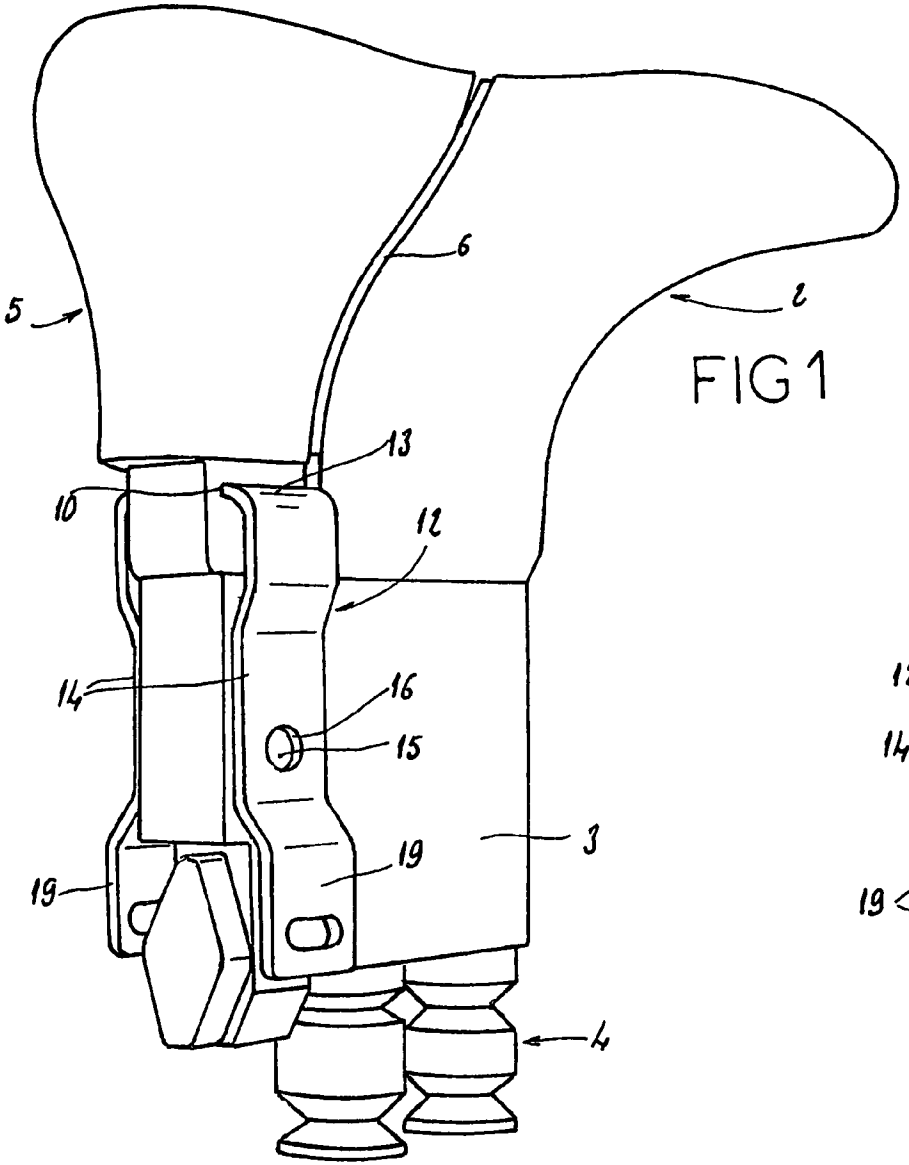
FIG. 1 is a perspective view of this last in the position of use.

FIG. 1 depicts a last comprising a main part 2 mounted on a support 3, the support itself being equipped, at the opposite end to the last, with grasping and manipulating means 4.

The main part of the last is supplemented by a rear part 5, the main 2 and rear 5 parts meeting along a circular surface 6 directed from the top of the upper downward and from front to back, the center of this surface 6 being situated toward the front end of the last and above the latter, the term "top" being considered as being the top with respect to a shoe rather than the top of the last in the position depicted in FIG. 1.

At the meeting surface 6, the main part of the last comprises a guide rib 7, whereas the rear part comprises a guide groove 8. The rear part 5 is equipped with a component 9 which, on the front side, comprises a slit 10 intended for the mounting of a stirrup-shaped clip piece 12. This stirrup-shaped clip piece 12 is made of metal and obtained from a metal sheet or flat metal strip, bent into the overall shape of a U. Attachment is achieved at the central branch 13 of the U which is engaged in the slit 10. The two lateral branches 14 of the U run parallel to one another and are intended to cover the two lateral walls of the support 3. This support 3, on its two lateral walls, has two fingers 15 projecting outwards and intended to engage in two holes 16 formed in the branches 14 of the U. In order to position the rear part 5 of the last on the support 3, the rear part of the last or, more specifically, the component 9 associated with it, comprises a centering finger 17 intended to engage in a centering hole 18 formed in the support. The end regions 19 of the branches 14 are parallel to the branches but offset outwards, so as not to be in contact with the lateral walls of the support 3, when the clip is in the position in which it is mounted on the support.

It is understandable that, in the position depicted in FIG. 1, the rear part 5 of the last is held perfectly with respect to the main part 2 thereof by virtue of the clip 12 the branches of which are pressed elastically against the lateral walls of the support 3, with the fingers 15 engaged in the holes 16 of the branches and the centering finger 17 engaged in the centering hole 18 belonging to the support. It is also understandable that, by parting the branches 14 under the effect of elastic deformation of the clip 12, it is possible to disengage the branches from the fingers 15 of the support with a view to retracting the rear part 5 of the last relative to the main part 2 thereof.

Figure 3:
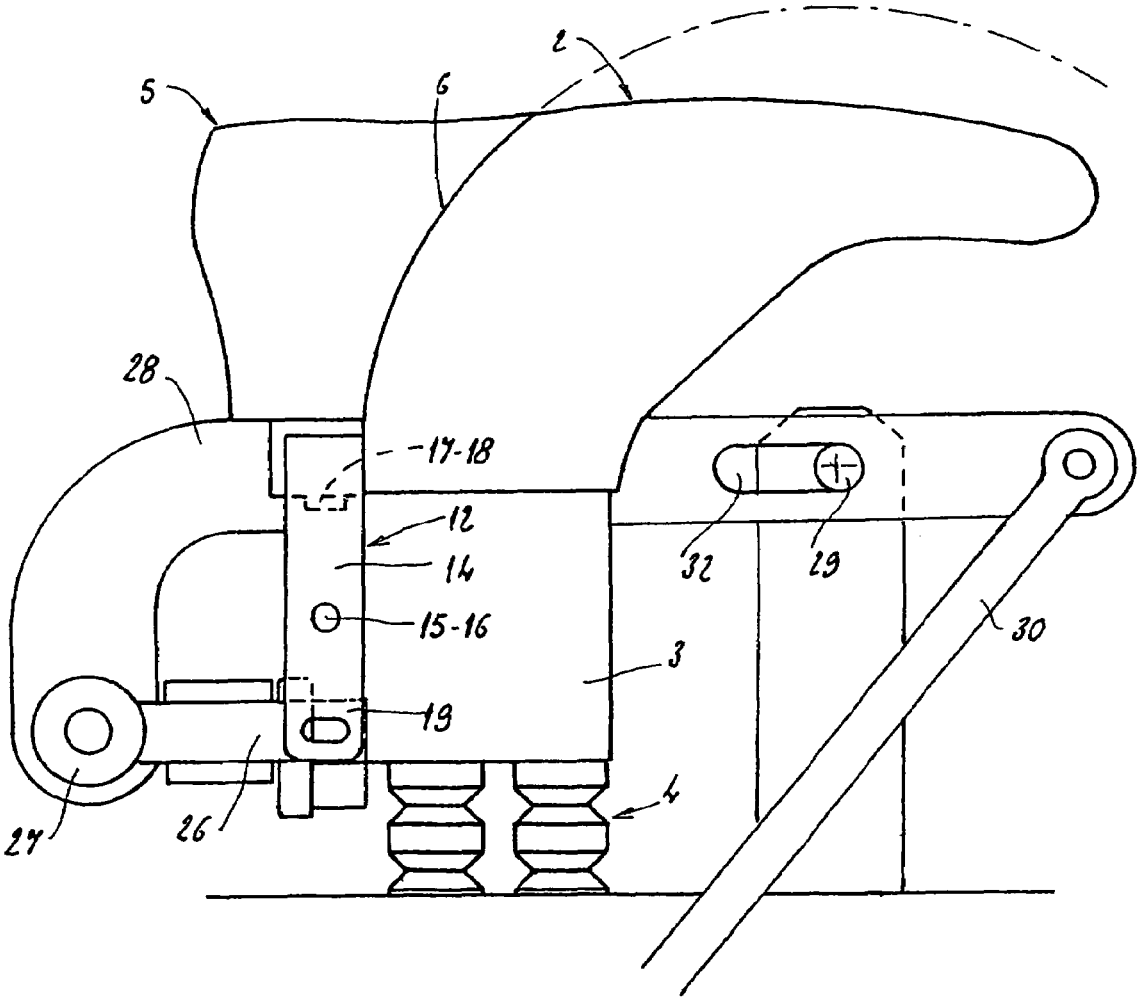
FIGS. 3 to 5 are three schematic side views depicting the last in the condition of use, in the process of the displacement of the rear part with respect to the main part and at the end of the displacement of the rear part with respect to the main part, respectively.

FIG. 3 depicts the rear part of the last fixed to the support and associated with the main part, in the work position.

Figure 4:
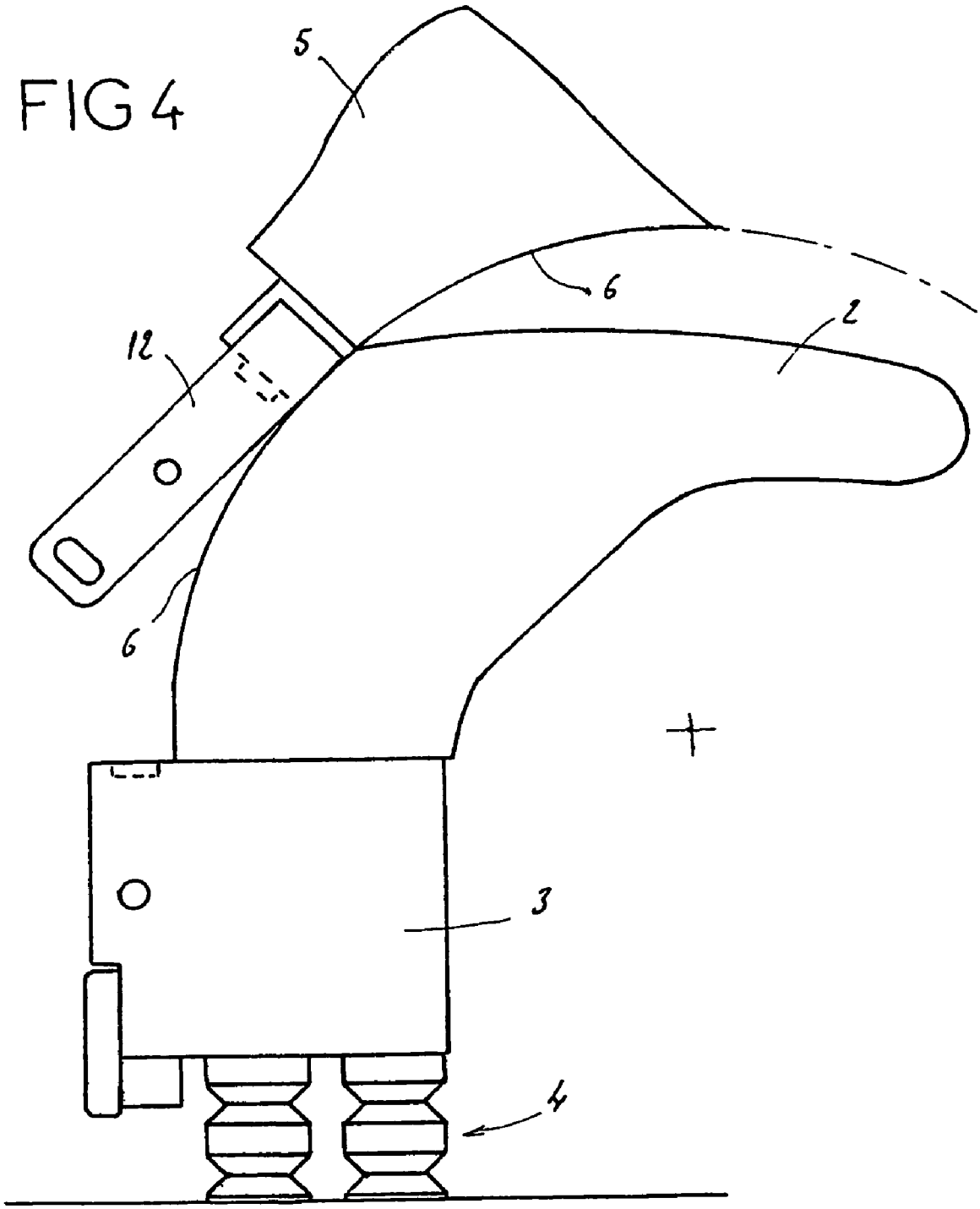

When the rear part 5 of the last needs to be disengaged from the main part 2, the branches 12 of the clip are parted to detach the rear part from the support 3, then the rear part is displaced in a pivoting movement about an axis A, as shown in FIG. 4, the displacement being along the meeting surface 6, and the lateral guidance of one part with respect to the other being provided, if need be, by collaboration between the guide rib 7 of the main part 2 and the guide groove 8 of the rear part 5. Pivoting continues to the position depicted in chain line in FIG. 5. Given the shape of the underside of the main part 2 and the displacement of the rear part 5 in an arc of a circle, the rear part finds itself some distance away from the main part. To make the assembly more compact, the rear part 5 is given a translational movement towards the main part 2, the axis A being displaced into the position B. In this position, the rear part 5 is practically pressed against the underside of the main part 2, leading to a very compact assembly.

Figure 6:
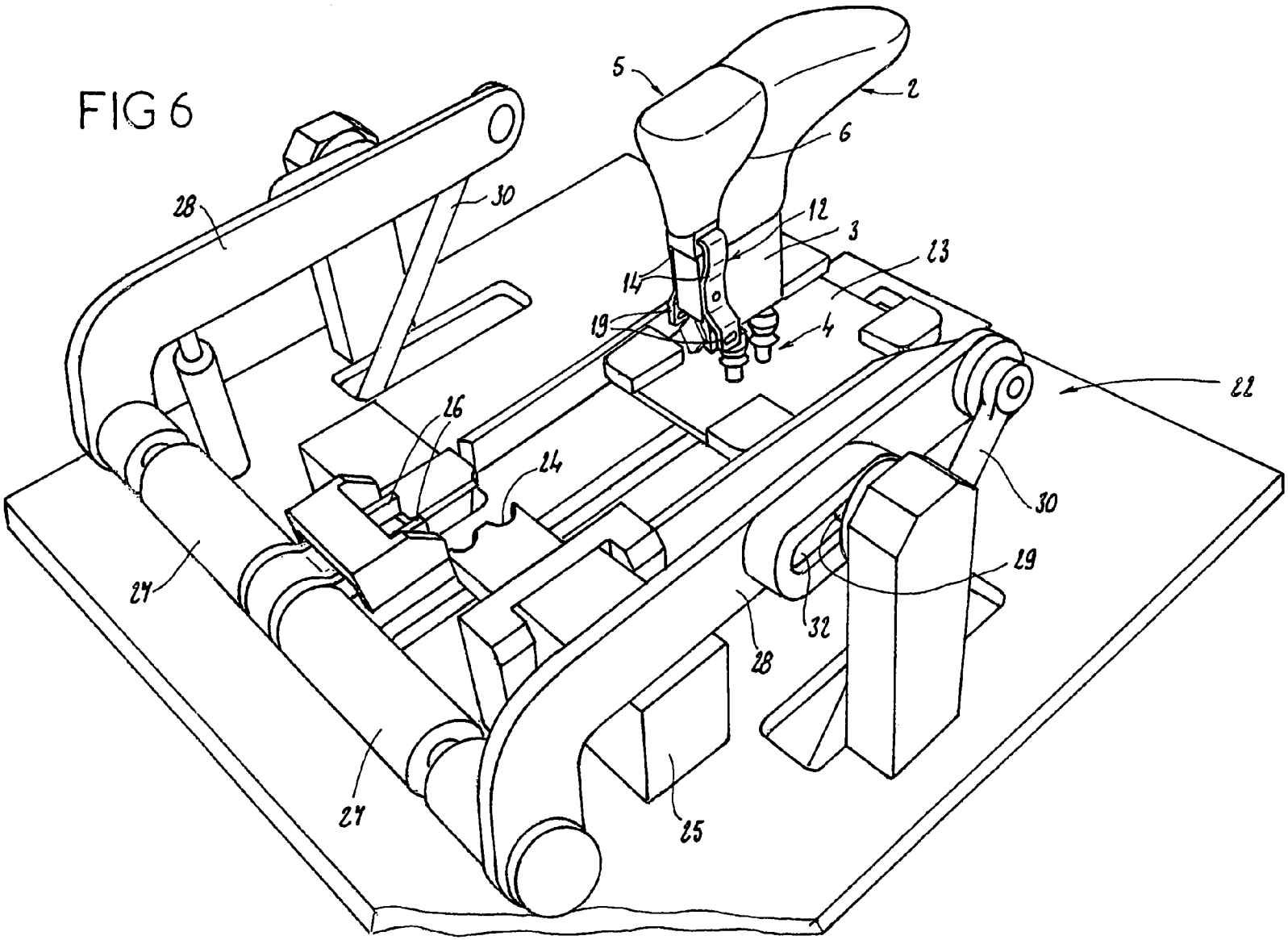
FIG. 6 is a perspective view of a manipulator intended to grasp hold of and displace the rear part relative to the main part.

The rear part is displaced using a manipulator illustrated in FIG. 6.

The manipulator 22 comprises a region for accepting a pallet 23 on which the last is mounted, via is grasping and manipulating means 4. In the position depicted in FIG. 6, a pallet 23 equipped with a last is not yet in the work position. The work position corresponds to the end-of-travel position in which the pallet is located in such a way that grippers 24 actuated by actuators 25 lock the last support holding means 4. The end regions 19 of the branches 14 of the clip 12 engage in forks 26 each of which may be actuated by an actuator 27, the two forks allowing the branches 14 to be parted and locked, particularly by the introduction of pegs, not depicted, in oblong apertures 28 in the branches 14 of the clip. The assembly bearing the forks 26 is mounted at the end of two arms 28 pivoting about a pivot pin 29 under the action of two actuators 30. It should be noted that the pivot pin 29 is positioned in a slot 32 and can be displaced under the action of actuators, not depicted, between position A, which corresponds to the position in FIG. 6, and position B, depicted in FIG. 5.

Figure 5:
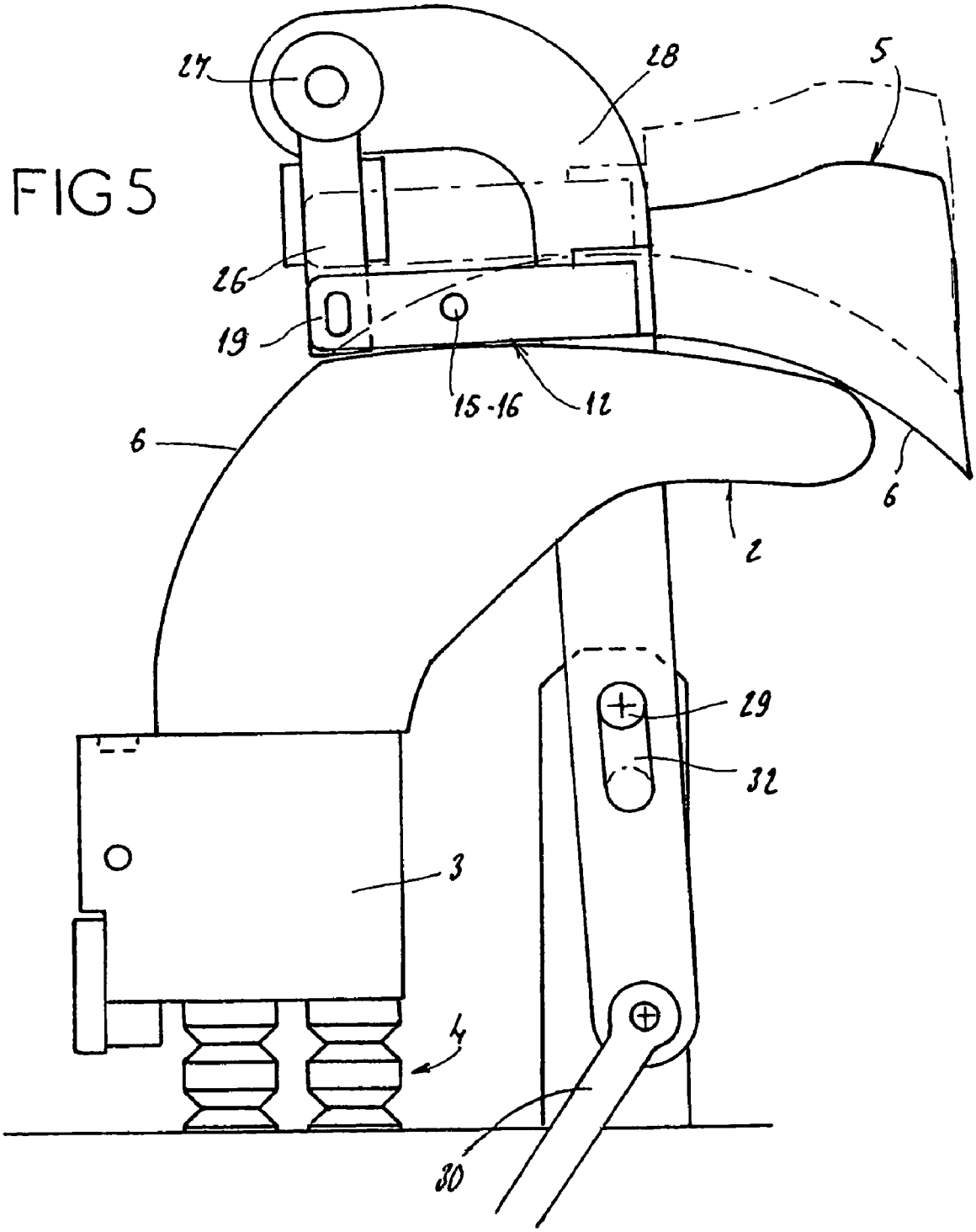

In practice, in order to switch the last from a normal position into a position in which the rear part 5 thereof is retracted, the pallet 23 is brought into abutment in the region of the manipulator 22, the grippers 24 are tightened to lock the gripping elements 4, the forks 26 are actuated to part the branches 14, then the assembly made up of the forks and of the arms 28 pivots, with the pivot pin 29 in position A, until the rear part of the last is brought into the position depicted in chain line in FIG. 5. The pivot pin 29 of the arms 28 is then displaced into position B, so that, through a corresponding translational movement, the rear part 5 of the last can be displaced into the position depicted in solid line in FIG. 5. An upper can then be mounted on the last, or, conversely, removed therefrom. The return of the rear part to the position in which it is fixed on the support is performed by performing the reverse operation.

As is evident from the foregoing, the invention provides a great improvement to the existing art by supplying a last and a manipulator associated with this last, of simple structure, allowing optimum retraction of the rear part of the last with respect to the main part thereof, and allowing the movements to be automated.

As goes without saying, the invention is not restricted to the sole embodiments of this last and of this manipulator which are described hereinabove by way of example; on the contrary, it encompasses all variants thereof.

The invention claimed is:

1. A multi-part last for the manufacture of shoes, comprising a main part (2) mounted on a support (3) equipped with holding means (4) and a rear part (5) mounted so that it can move with respect to the main part (2) between a position in which it forms the last with the main part for operations of producing the shoe and a position in which the rear part is displaced relative to the main part in a direction of retraction under the main part, characterized in that:

the rear part (5) and the main part (2) meet along a circular surface (6) of horizontal axis situated above and on the front side of the last, the rear part (5) is equipped with a clip (12) in the overall shape of a U that is elastically deformable and the branches (14) of which are intended to lock onto the last support (3), means being provided for disengaging the clip (12) from the support (3) and displacing the rear part (5) with respect to the main part (2) into a retracted position, and vice versa.

2. The last as claimed in claim 1, characterized in that the clip (12) is made of metal.

3. The last as claimed in claim 1 characterized in that the branches (14) of the clip (12) each comprise at least one hole (16) for the engagement of at least one finger (15) belonging to the support (3) when the clip (12) is in the position in which it is locked onto the support (3).

4. The last as claimed in claim 1 characterized in that the central branch (13) of the clip (12) comprises a centering finger (17) intended to engage in a hole (18) belonging to the support (3) when the rear part (5) of the last is in the position in which it is locked onto the support (3).

5. The last as claimed in claim 1 characterized in that the clip (12) is mounted removably on the rear part (5) of the last by engaging in a slit (10) formed in this rear part or in a component (10) secured thereto.

6. The last as claimed in claim 1 characterized in that the curved contact surfaces (6) of the main part (2) and of the rear part (5) of the last are fitted with a guide rib (7) and with a guide groove (8) respectively, providing guidance in the plane of displacement of these two parts one with respect to the other.

7. The last as claimed in claim 1 characterized in that the end regions (19) of the two branches (14) of the clip (12) are offset outwards, parallel to the respective planes of the two branches.

8. The last as claimed in claim 1 characterized in that the means provided for disengaging the clip from the support and displacing the rear part with respect to the main part consist of an external manipulator (22), that is to say one independent of the main part (2) of the last, grasping the ends of the branches (14) of the clip, detaching them from the support, and then displacing the rear part (5) of the last relative to the main part (2) in a pivoting movement.

9. The last as claimed in claim 6, characterized in that the manipulator comprises two forks (26) which, intended to grasp the end regions (19) of the two branches (14) of the clip (12), are associated with actuators (27) that enable the branches (14) to be parted and grasped in order to disengage them from the last support, the forks themselves being mounted on a support fixed on at least one arm (28) mounted to pivot about the pivot pin (29) on which the curved surface (6) where the main and rear parts of the last meet is centered.

10. The last as claimed in claim 8, characterized in that, at the end of the pivoting travel, the manipulator (22) displaces the rear part of the last (5) in a translational movement in order to press it firmly against the underside of the main part (2).

11. The last as claimed in claim 10, characterized in that the pivot pin (29) about which the arm (28) bearing the forks (26) of the manipulator (22) pivots is mounted in an elongate slot (23) which, with the aid of an actuator, allows this pivot pin, the forks and the rear part of the last to be displaced toward the underside of the main part (2) of this last at the end of the pivoting movement of the rear part (5).

* * * * *